US011808501B2

(12) United States Patent
Hashimoto

(10) Patent No.: US 11,808,501 B2
(45) Date of Patent: Nov. 7, 2023

(54) DETERMINATION DEVICE

(71) Applicant: Yazaki Energy System Corporation, Tokyo (JP)

(72) Inventor: Tomohiko Hashimoto, Hamamatsu (JP)

(73) Assignee: YAZAKI ENERGY SYSTEM CORPORATION, Tokyo (JP)

( * ) Notice: Subject to any disclaimer, the term of this patent is extended or adjusted under 35 U.S.C. 154(b) by 0 days.

(21) Appl. No.: 17/389,477

(22) Filed: Jul. 30, 2021

(65) Prior Publication Data

US 2022/0049887 A1 Feb. 17, 2022

(30) Foreign Application Priority Data

Aug. 17, 2020 (JP) ..... 2020-137381

(51) Int. Cl.
*F25B 49/04* (2006.01)
*F25B 47/00* (2006.01)

(52) U.S. Cl.
CPC ..... *F25B 49/043* (2013.01); *F25B 47/003* (2013.01)

(58) Field of Classification Search
CPC .... F25B 47/003; F25B 43/046; F25B 49/043; F25B 43/04; Y02B 30/62; Y02A 30/27
See application file for complete search history.

(56) References Cited

U.S. PATENT DOCUMENTS 5,956,969 A * 9/1999 Furukawa ..... C01B 3/505 62/85
2001/0009101 A1* 7/2001 Ishikawa ..... F25B 43/046 62/476

FOREIGN PATENT DOCUMENTS

| | | | |
|---|---|---|---|
| JP | 07-332813 A | | 12/1995 |
| JP | 07-332819 A | | 12/1995 |
| JP | H07332819 A | * | 12/1995 |
| JP | 2001263876 A | * | 9/2001 |
| JP | 2019129089 A | * | 8/2019 |

* cited by examiner

*Primary Examiner* — Frantz F Jules
*Assistant Examiner* — Webeshet Mengesha
(74) *Attorney, Agent, or Firm* — Sughrue Mion, PLLC

(57) ABSTRACT

A determination device able to determine a cause of generation of gas with a simple configuration is provided. The determination device includes a pressure gauge that detects pressure in a gas storage chamber that stores non-condensable gas generated in an absorber of an absorption refrigerator, and a hydrogen sensor that detects an amount of hydrogen discharged from the gas storage chamber. Further, a determining unit determines a cause of generation of the non-condensable gas stored in the gas storage chamber based on a detection result of the hydrogen sensor and a detection result of the pressure gauge.

4 Claims, 3 Drawing Sheets

DETERMINATION DEVICE

TECHNICAL FIELD

The present invention relates to a determination device for determining a cause of generation of gas generated in an absorption refrigerator.

BACKGROUND

Hydrogen generated inside an absorption refrigerator is collected in a gas storage chamber and is discharged to the outside by a gas extraction device including a palladium tube or a palladium cell or the like made of palladium or palladium alloy. Palladium, when it is heated and kept above about 300° C. or higher, has a property of allowing only hydrogen to pass therethrough. Using this property of palladium, the gas extraction device can selectively discharge only hydrogen.

Patent Document 1 describes that, when hydrogen gas is generated due to corrosion in a system and the hydrogen gas is discharged from a palladium cell, a hydrogen gas detector detects the generation of the hydrogen gas and detects a corrosion inhibitor added in solution is consumed.

PRIOR ART DOCUMENT

Patent Document 1: JP H7-332813 A

SUMMARY OF THE INVENTION

Problem to be Solved by the Invention

In the absorption refrigerator, hydrogen gas is generated due to corrosion in the refrigerator, while outside air enters inside the refrigerator when there is inleak from outside the refrigerator. Thus, gas other than hydrogen may also be stored in the gas storage chamber. The gas storage chamber is mounted with a pressure gauge that generates a warning when an amount of stored gas increases. A service engineer or someone who is informed by the issuance of the warning uses a vacuum pump to discharge the gas in the gas storage chamber through a gas extraction valve provided separately from the above-described gas extraction device.

At this time, the subsequent measures to be taken differ depending on whether the discharged gas is hydrogen or outside air (atmospheric air). If it is hydrogen, then corrosion inhibitor is charged, and if it is outside air, then a leak location is identified. Thus, conventionally, the discharged gas is burned to determine whether it is hydrogen or not. In this method, unless the gas in the gas storage chamber is discharged using the vacuum pump, the stored gas cannot be identified and the cause of the pressure rise in the refrigerator cannot be presumed. Further, since the hydrogen burning occurs even in a relatively small amount, it is difficult to correctly presume the cause of the pressure rise in the refrigerator.

In view of this, an object of the present invention is to provide a determination device capable of determining a cause of generation of gas with a simple configuration.

Solution to the Problem

In order to achieve the above-described object, the present invention provides, in a first aspect, a determination device including a pressure detecting unit configured to detect pressure in a storage that stores gas discharged from inside an absorption refrigerator, a hydrogen detecting unit configured to detect an amount of hydrogen discharged from the storage, and a determining unit configured to determine a cause of generation of the gas based on a detection result of the hydrogen detecting unit and a detection result of the pressure detecting unit.

Advantageous Effect of the Invention

As described above, according to the present invention, it is possible to determine a cause of generation of the gas stored in the storage based on the amount of hydrogen discharged from the storage and the pressure in the storage. Thus, it is possible to identify the gas stored in the storage prior to discharging the gas in the storage using the vacuum pump, thus the cause of the pressure rise in the refrigerator can be presumed correctly, and the excessive corrosion inhibitor charging can be prevented. Thus, the cause of generation of the gas can be determined with a simple configuration without a need to burn the discharged gas.

DETAILED DESCRIPTION OF THE EXEMPLARY EMBODIMENTS

Figure 1:
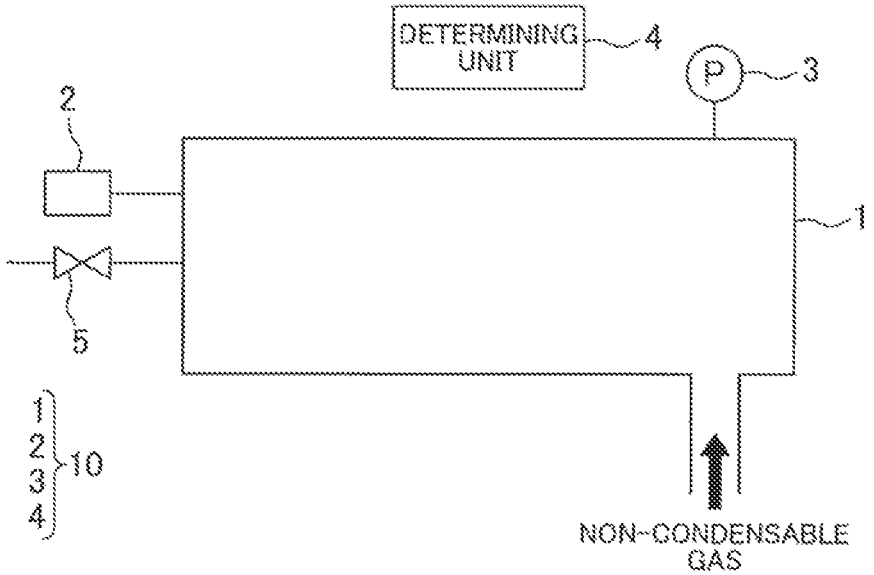
FIG. 1 is a schematic configuration diagram showing a part of an absorption refrigerator including a determination device according to one embodiment of the present invention.

In the following, one embodiment of the present invention will be described with reference to the drawings. FIG. 1 is a schematic configuration diagram showing a part of an absorption refrigerator including a determination device according to one embodiment of the present invention. As shown in FIG. 1, a determination device 10 includes a gas storage chamber 1, a gas extraction device 2, a pressure gauge 3 and a determining unit 4.

As known, in the absorption refrigerator, devices such as a regenerator, a condenser, an evaporator and an absorber are sequentially connected via pipes to circulate refrigerant such as water so that the refrigerant is absorbed by and released from absorbing liquid such as lithium bromide aqueous solution, thereby performing heat transfer to generate cold heat used for a cooling operation and to generate hot heat used for a heating operation.

In the absorption refrigerator, an infinitesimal amount of oxygen entering the refrigerator causes corrosion on pipes and inner surfaces of respective devices, and this corrosion causes generation of hydrogen in the refrigerator. In addition, although the absorption refrigerator is a high vacuum system as a whole and has high airtightness provided by welding or the like, it is impossible to avoid the atmospheric components (outside air) from entering through a pinhole and/or a connecting portion, thus the atmospheric components such as nitrogen and oxygen will increase as time passes.

When the concentration of non-condensable gas such as the above-described hydrogen gas and the atmospheric components (outside air) entered from the outside of the refrigerator is increased, evaporation of the refrigerant is suppressed and refrigeration capacity is reduced. Thus, the non-condensable gas such as the hydrogen gas is sent into the gas storage chamber 1 using a well-known method such as an ejector type method. The gas storage chamber 1 stores the non-condensable gas sent thereto in a manner as described above. The stored non-condensable gas is discharged to the outside of the refrigerator using the gas extraction device 2 or a vacuum pump or the like.

Figure 2:
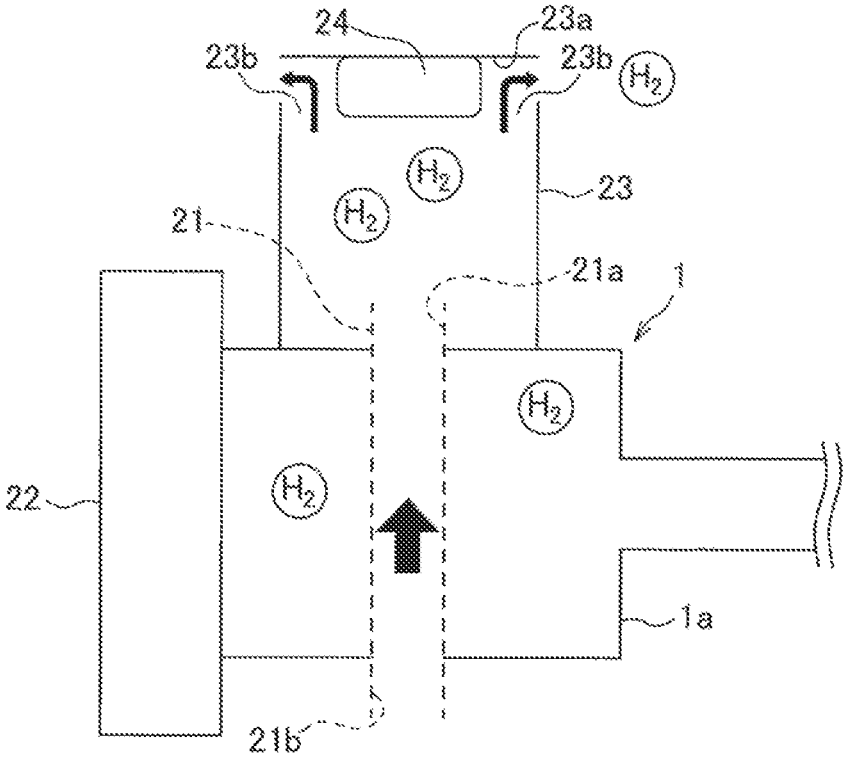
FIG. 2 is a schematic configuration diagram of a gas extraction device shown in FIG. 1.

The gas extraction device 2 discharges the hydrogen gas stored in the gas storage chamber 1 to the outside of the refrigerator, as described above. As shown in FIG. 2, the gas extraction device 2 includes a palladium tube 21, a heater 22, a conduit 23 and a hydrogen sensor 24.

The palladium tube 21 is formed of palladium or palladium alloy and is formed in a tubular shape (straight tube) including apertures 21*a*, 21*b* at both ends thereof. The palladium tube 21 is disposed so as to penetrate an end portion 1*a* of the gas storage chamber 1. The palladium tube 21 is provided such that a longitudinal direction thereof is arranged along a vertical direction. In other words, the palladium tube 21 is provided such that the aperture 21*a* is positioned on an upper side and the aperture 21*b* is positioned on a lower side. Further, the palladium tube 21 is arranged such that outside air is introduced therein from the lower aperture 21*b*. Thus, the palladium tube 21 also functions as a ventilation tube that guides the outside air to the conduit 23.

The heater 22 as a heating unit is disposed in the vicinity of the palladium tube 21 and at the end portion 1*a* of the gas storage chamber 1. The heater 22 heats the palladium tube 21 to a temperature of about 300° C. at which the palladium tube 21 exhibits the property of allowing hydrogen to pass therethrough.

The conduit 23 is provided on the upper aperture 21*a* side of the palladium tube 21. The conduit 23 is formed in a bottomed tube one end portion of which is opened and another end portion of which includes a bottom portion 23*a*. The conduit 23 is mounted to the gas storage chamber 1 such that the bottom portion 23*a* is positioned up so the opened end portion thereof covers the upper aperture 21*a* of the palladium tube 21, thus the gas discharged from the upper aperture 21*a* of the palladium tube 21 is guided into the conduit 23. Further, the conduit 23 includes a gap 23*b* for discharging that is formed on the bottom portion 23*a* side, so that the gas guided into the conduit 23 is discharged from the gap 23*b*.

The hydrogen sensor 24 as a hydrogen detecting unit is installed at the bottom portion 23*a* in the conduit 23. That is, the hydrogen sensor 24 is provided on the aperture 21*a* side of the palladium tube 21. The hydrogen sensor 24 is a sensor in which signal intensity outputted therefrom varies in accordance with an amount (concentration) of hydrogen contained in the gas in the conduit 23 (i.e., the mixed gas composed of outside air and the hydrogen). The hydrogen sensor 24 may be a known type of sensor such as a hot wire semiconductor type sensor.

In the gas extraction device 2, the palladium tube 21 is heated by the heater 22, thereby the hydrogen in the gas storage chamber 1 penetrates an outer periphery of the palladium tube 21 and enters the palladium tube 21. Also, when the palladium tube 21 is heated by the heater 22, an updraft is created in the palladium tube 21. Thus, the hydrogen that has entered the palladium tube 21 is guided into the conduit 23 together with the outside air that has entered through the lower aperture 21*b* of the palladium tube 21. Then, the hydrogen guided into the conduit 23 is discharged from the gaps 23*b* to the outside. Further, the heated gas guided to the conduit 23 causes convection inside the conduit 23 and thereby prevents stagnation around the hydrogen sensor 24. That is, among the heated gas, the gas that is not discharged from the gaps 23*b* is cooled in the vicinity of the hydrogen sensor 24, thus it moves downward to the aperture 21*a* side of the palladium tube 21. The gas moved downward is heated again by the heated palladium tube 21 and moves upward. Thus, the convection occurs inside the conduit 23.

The amount of hydrogen discharged from the palladium tube 21 is determined by hydrogen partial pressure in the gas storage chamber 1, thus the hydrogen discharged from the gas extraction device 2 increases as the hydrogen stored in the gas storage chamber 1 increases. The amount of hydrogen in the conduit 23 is detected by the hydrogen sensor 24, and signal intensity corresponding to the amount of hydrogen is outputted. That is, the hydrogen sensor 24 detects the amount of hydrogen contained in the gas discharged from the gas storage chamber 1.

The pressure gauge 3 as a pressure detecting unit measures (detects) pressure in the gas storage chamber 1. The pressure gauge 3 may be a known pressure gauge and is not limited to a particular device.

The determining unit 4 is constituted of a microcomputer and such including a central processing unit (CPU) configured to perform various processing and control and such according to a predetermined program, ROM that is read-only memory in which a program and such for the processing to be performed by the CPU is stored, and RAM that is read-write memory in which various data is stored and which includes an area required for the processing operations of the CPU. The determining unit 4 is configured to issue a warning based on the detection result of the pressure gauge 3 and to determine the cause of storing of the non-condensable gas in the gas storage chamber 1 based on the detection result of the pressure gauge 3 and the detection result of the hydrogen sensor 24.

The reference sign 5 shown in FIG. 1 indicates a vacuuming valve. The vacuuming valve 5 is provided between the gas storage chamber 1 and a vacuum pump (not shown) that discharges the non-condensable gas in the gas storage chamber 1, and is configured to open and close a tube passage between the gas storage chamber 1 and the vacuum pump.

Figure 3:
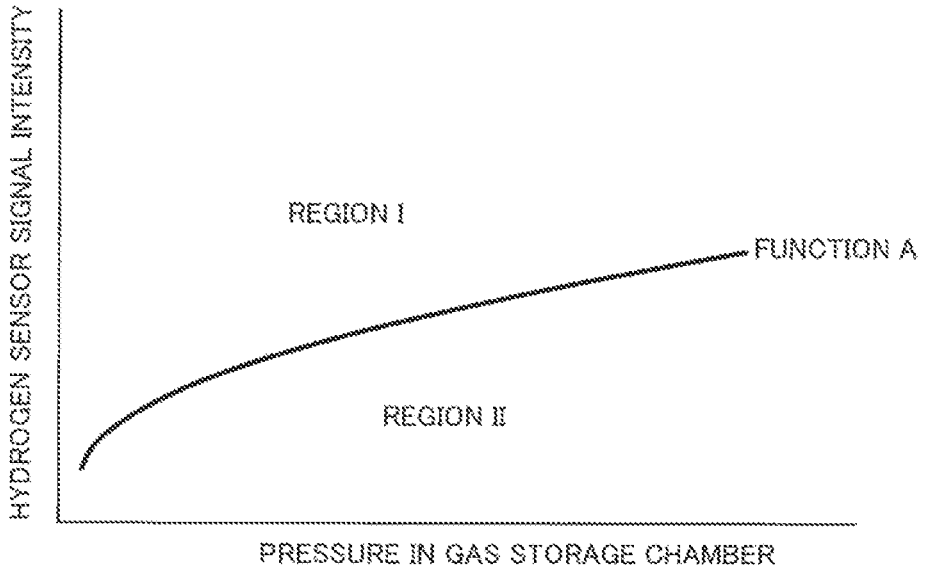
FIG. 3 is a graph showing threshold for determining whether gas stored in a gas storage chamber is due to hydrogen generation in the refrigerator or not.

FIG. 3 shows a graph showing a threshold for determining whether the gas stored in the gas storage chamber is due to the hydrogen generation in the refrigerator or not. Based on FIG. 3, the threshold of the signal intensity of the hydrogen sensor is defined from the pressure in the gas storage chamber. The amount of hydrogen penetrating through the palladium tube 21 is represented by a function of the hydrogen partial pressure in the refrigerator. In FIG. 3, if the signal intensity of the hydrogen sensor 24 is in a region I (i.e., above the function A), then it can be said that a dominant cause of the rise in the pressure of the non-condensable gas in the gas storage chamber 1 is the generation of hydrogen, and, if the signal intensity of the hydrogen sensor 24 is in a region II (i.e., below the function A), then it can be said that a dominant cause of the rise in the pressure of the non-condensable gas in the gas storage chamber 1 is the inleak of the outside air.

Thus, by defining the threshold of the signal intensity (the amount of hydrogen) corresponding to the pressure value of the pressure gauge 3 using the function A shown in FIG. 3, and, by determining, based on that threshold, the signal intensity of the hydrogen sensor 24 when the warning is issued or during a maintenance operation or during monitoring, it is possible to determine whether the dominant cause of the pressure rise in the gas storage chamber 1 is the generation of hydrogen or the inleak of the outside air.

In the case where the dominant cause of the pressure rise in the gas storage chamber 1 is the generation of hydrogen, it can be said that corrosion has occurred in the refrigerator as described above, and thus it can be determined that, as the cause of the generation of the gas stored in the gas storage chamber 1, the gas was generated in the refrigerator. On the other hand, in the case where the dominant cause of the pressure rise in the gas storage chamber 1 is the inleak of the outside air, it can be said that the outside air has leaked into the refrigerator as described above, and thus it can be determined that, as the cause of generation of gas stored in the gas storage chamber 1, the gas had leaked in from the outside of the refrigerator.

In the case where the dominant cause of the pressure rise in the gas storage chamber 1 is the generation of hydrogen, it is assumed that corrosion in the refrigerator is advancing, thus a maintenance operation to charge the corrosion inhibitor is performed. On the other hand, in the case where the dominant cause of the pressure rise in the gas storage chamber 1 is the inleak of the outside air, it is assumed that the inleak is occurring in the refrigerator, thus a maintenance operation to identify the leak location is performed.

Figure 4:
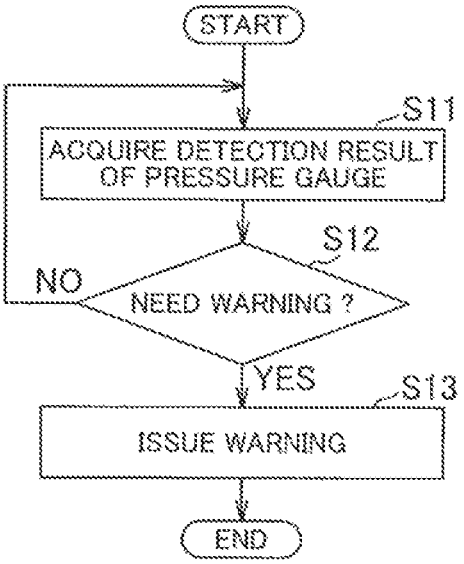
FIG. 4 is a flowchart showing a warning operation in a determining unit shown in FIG. 1.

Next, an operation of the determining unit 4 will be described with reference to flowcharts of FIG. 4 and FIG. 5. FIG. 4 shows a flowchart of a warning operation. First, a detection result of the pressure gauge 3 is acquired (step S11). Next, based on the detection result of the pressure gauge 3 acquired in step S11, it is determined whether there is a need to issue a warning (step S12). That is, it is determined whether the pressure value in the gas storage chamber 1 is equal to or greater than a predetermined value and there is a need to quickly discharge the non-condensable gas using the vacuum pump or the like. If there is no need to issue a warning (NO in step S12), the process returns to step S11. On the other hand, if there is a need to issue a warning (YES in step S12), the warning is issued to urge a service engineer or someone to take measures (step S13).

Figure 5:
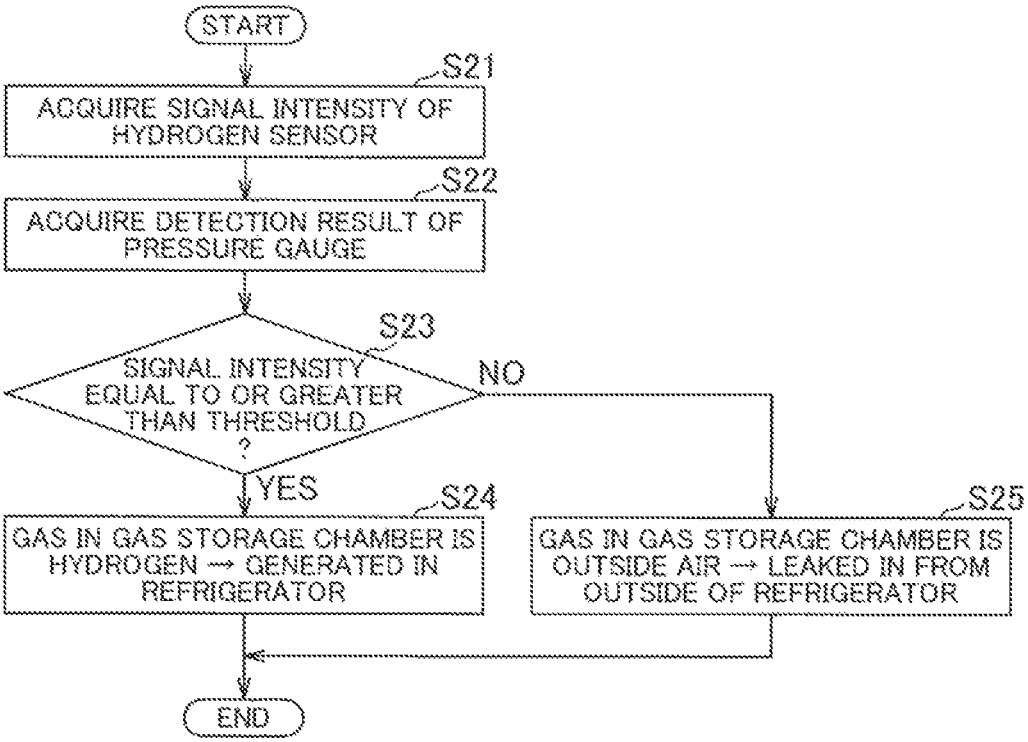
FIG. 5 is a flowchart showing a determining operation in the determining unit shown in FIG. 1.

Next, FIG. 5 shows a flowchart of a determining operation. First, signal intensity is acquired from the hydrogen sensor 24 (step S21). Then, a detection result is acquired from the pressure gauge 3 (step S22). Once the detection result is acquired from the pressure gauge 3, the threshold of the signal intensity can be obtained using the function A shown in FIG. 3. Step S21 and step S22 may be executed in a reversed order, or may be executed simultaneously and in parallel.

Next, it is determined whether the signal intensity acquired from the hydrogen sensor 24 is equal to or greater than the threshold (step S23). This threshold is a value defined by the function A shown in FIG. 3.

If the signal intensity is equal to or greater than the threshold (YES in step S23), it is determined that the dominant cause of the pressure rise in the gas storage chamber 1 is the generation of hydrogen and that the non-condensable gas was generated in the refrigerator (step S24). On the other hand, if the signal intensity is less than the threshold (NO in step S23), it is determined that the dominant cause of the pressure rise in the gas storage chamber 1 is the inleak of the outside air and that the non-condensable gas had leaked in from the outside of the refrigerator (step S25).

When the determining unit 4 is constituted of a PC and such, the determination results may be displayed on a monitor screen or the like included in the PC. Further, the determination results may be transmitted from the determining unit 4 to a terminal device of another PC and such wirelessly or via a communication wire. Alternatively, the determination results may be stored as a log in a storage device (not shown). Based on the determination results, a service engineer or someone will take measures.

That is, according to the flowchart of FIG. 5, the determining unit 4 obtains a threshold that is defined by the function A based on the signal intensity of the hydrogen sensor 24 and the pressure value detected by the pressure gauge 3. Then, the determining unit 4 determines that the non-condensable gas was generated in the refrigerator if the amount of hydrogen detected by the hydrogen sensor 24 is equal to or greater than the threshold, and determines that the non-condensable gas had leaked in from the outside of the refrigerator if the amount of hydrogen detected by the hydrogen sensor 24 is less than the threshold.

According to this embodiment, the determination device 10 includes the pressure gauge 3 configured to detect the pressure in the gas storage chamber 1 that stores the non-condensable gas generated in the absorber of the absorption refrigerator, and the hydrogen sensor 24 configured to detect the amount of hydrogen discharged from the gas storage chamber 1. In addition, the determining unit 4 determines the cause of the generation of the non-condensable gas stored in the gas storage chamber 1 based on the detection result of the hydrogen sensor 24 and the detection result of the pressure gauge 3.

With the determination device 10 configured as described above, it is possible to determine whether the non-condensable gas was generated inside the refrigerator or outside the refrigerator based on the concentration of the hydrogen discharged from the gas storage chamber 1 and the pressure in the gas storage chamber 1. Thus, the cause of the generation of the non-condensable gas can be determined quantitatively with a simple configuration without a need to burn the non-condensable gas. Thus, it is possible to easily make a decision on what should be done in the subsequent maintenance operation. In addition, it is possible to identify the gas stored in the gas storage chamber 1 prior to discharging the gas using the vacuum pump, thus the cause of pressure rise in the refrigerator can be presumed correctly, thereby preventing excessive corrosion inhibitor charging.

Further, the determining unit 4 obtains the threshold that is defined by the function A based on the pressure value detected by the pressure gauge 3 and the signal intensity. Then, the determining unit 4 determines that the non-condensable gas was generated in the refrigerator if the amount of hydrogen detected by the hydrogen sensor 24 is equal to or greater than the threshold, and determines that the non-condensable gas had leaked in from the outside of the refrigerator if the amount of hydrogen detected by the hydrogen sensor 24 is less than the threshold.

With the determining unit 4 operating as described above, the threshold based on the function A as shown in FIG. 3 can be used to determine whether the dominant cause of the pressure rise in the gas storage chamber 1 is the generation of hydrogen or the inleak of the outside air. Further, it is possible to determine the cause of generation of the non-condensable gas which causes the pressure rise at the same time as the issuance of the warning, thus it is clear what to do when the warning is required, facilitating the maintenance operation.

Further, it is possible to determine that the hydrogen has generated due to corrosion in the refrigerator when the generation of hydrogen is dominant, and it is possible to determine that the outside air has leaked in from the outside of the refrigerator when the inleak of the outside air is dominant.

Further, since the hydrogen sensor 24 is provided to the gas extraction device 2 including the palladium tube 21 penetrating through the gas storage chamber 1 and the heater 22 for heating the palladium tube 21, the gas extraction device 2 for exhausting the hydrogen can be used to detect the amount of hydrogen.

Further, since the palladium tube includes the apertures on both ends in the longitudinal direction of the palladium tube and the longitudinal direction is arranged along the vertical direction, the updraft generated by heating of the palladium tube 21 can guide the hydrogen to the conduit 23. Thus, components and such for controlling the flow of air of a blower fan or the like are not required, allowing to discharge hydrogen with a simple structure and reducing cost.

Further, since the hydrogen sensor 24 is provided on the upper aperture side of the palladium tube, it is possible to efficiently detect the hydrogen guided to the conduit 23 by the updraft. Further, by virtue of this structure, convection of the heated gas guided to the conduit 23 occurs in the conduit 23, thereby preventing stagnation of the gas around the hydrogen sensor 24.

The present invention is not limited to the embodiment described above. That is, a person skilled in the art can make various modifications and carry out according to conventionally known knowledge without departing from the gist of the present invention. These modified versions are of course within the scope of the present invention as long as they include the configuration of the determination device of the present invention.

LIST OF REFERENCE SIGNS

1 gas storage chamber (storage)
2 gas extraction device
3 pressure gauge (pressure detecting unit)
4 determining unit
21 palladium tube
22 heater (heating unit)
24 hydrogen sensor (hydrogen detecting unit)

What is claimed is:

1. A determination device comprising:

a pressure detecting unit configured to detect pressure in a storage that stores gas discharged from inside an absorption refrigerator;

a hydrogen detecting unit configured to detect an amount of hydrogen discharged from the storage; and a determining unit configured to determine whether a dominant cause of a pressure rise in the storage is a generation of hydrogen or an inleak of an outside air based on a detection result of the hydrogen detecting unit and a detection result of the pressure detecting unit, wherein the hydrogen detecting unit is provided at a gas extraction device, the gas extraction device including a palladium tube that penetrates through the storage and a heating unit that heats the palladium tube, the palladium tube has apertures arranged on both ends in a longitudinal direction of the palladium tube, and the palladium tube is arranged such that the longitudinal direction is arranged along a vertical direction, wherein the palladium tube penetrates through an end portion of the storage such that outside air is introduced into the palladium tube from a lower aperture of the apertures of the palladium tube, and wherein, when the palladium tube is heated by the heating unit, an updraft is created in the palladium tube, thereby guiding hydrogen that has entered the palladium tube into a conduit together with outside air that has entered through the lower aperture of the palladium tube, the conduit being disposed on an upper aperture side of the palladium tube.

2. The determination device according to claim 1, wherein the determining unit includes a threshold of the amount of hydrogen that is defined based on a pressure value detected by the pressure detecting unit, and the determining unit is configured to:

determine that the gas is generated inside the absorption refrigerator when the amount of hydrogen detected by the hydrogen detecting unit is equal to or greater than the threshold; and determine that the gas is leaked in from outside the absorption refrigerator when the amount of hydrogen detected by the hydrogen detecting unit is less than the threshold.

3. The determination device according to claim 2, wherein the threshold is defined by a function based on the pressure value and the amount of hydrogen.

4. The determination device according to claim 1, wherein the hydrogen detecting unit is provided on the upper aperture side of the palladium tube.

* * * * *